US007013690B2

(12) United States Patent
Massee

(10) Patent No.: US 7,013,690 B2
(45) Date of Patent: Mar. 21, 2006

(54) METHOD AND FORMING MACHINE FOR DEFORMING A HOLLOW WORKPIECE

(75) Inventor: Johan Massee, Lunteren (NL)

(73) Assignee: John Massee, Lunetren (NL)

( * ) Notice: Subject to any disclaimer, the term of this patent is extended or adjusted under 35 U.S.C. 154(b) by 27 days.

(21) Appl. No.: 10/451,893

(22) PCT Filed: Dec. 21, 2001

(86) PCT No.: PCT/NL01/00939

§ 371 (c)(1),
(2), (4) Date: Jun. 26, 2003

(87) PCT Pub. No.: WO02/062500

PCT Pub. Date: Aug. 15, 2002

(65) Prior Publication Data

US 2004/0050130 A1 Mar. 18, 2004

(30) Foreign Application Priority Data

Dec. 29, 2000 (NL) ..... 1017010

(51) Int. Cl.
*B21D 22/00* (2006.01)

(52) U.S. Cl. ..... 72/84; 72/82; 72/121

(58) Field of Classification Search ..... 72/82, 72/83, 84, 85, 110, 120, 121, 370.01, 370.12, 72/379.4; 29/890
See application file for complete search history.

(56) References Cited

U.S. PATENT DOCUMENTS

| | | | | |
|---|---|---|---|---|
| 4,036,044 | A * | 7/1977 | Yoshimura | 72/85 |
| 5,909,916 | A * | 6/1999 | Foster et al. | 29/890 |
| 6,212,926 | B1 * | 4/2001 | Jenness | 72/69 |
| 6,317,976 | B1 * | 11/2001 | Aranda et al. | 29/890 |
| 6,381,843 | B1 * | 5/2002 | Irie et al. | 29/890 |
| 6,386,010 | B1 * | 5/2002 | Irie et al. | 72/84 |
| 6,467,322 | B1 * | 10/2002 | Nogami et al. | 72/121 |
| 6,637,248 | B1 * | 10/2003 | Ishii et al. | 72/121 |

FOREIGN PATENT DOCUMENTS

| | | |
|---|---|---|
| EP | 0 916 426 | 5/1999 |
| EP | 0 916 428 | 5/1999 |

* cited by examiner

*Primary Examiner*—Ed Tolan
(74) *Attorney, Agent, or Firm*—Westman, Champlin & Kelly, P.A.

(57) ABSTRACT

The invention pertains to a method and forming machine for deforming a hollow workpiece having at least one open end, wherein the workpiece is clamped down in a clamping device, at least one forming tool is placed into contact with the surface of the workpiece, the workpiece and this forming tool are rotated relative to each other about an axis, and the workpiece is deformed by means of the forming tool. During at least part of the deforming, the forming tool is being moved back and forth at a frequency that is substantially equal to or a multiple of the frequency of the rotation of the deformed part or the part to be deformed of the workpiece.

11 Claims, 4 Drawing Sheets

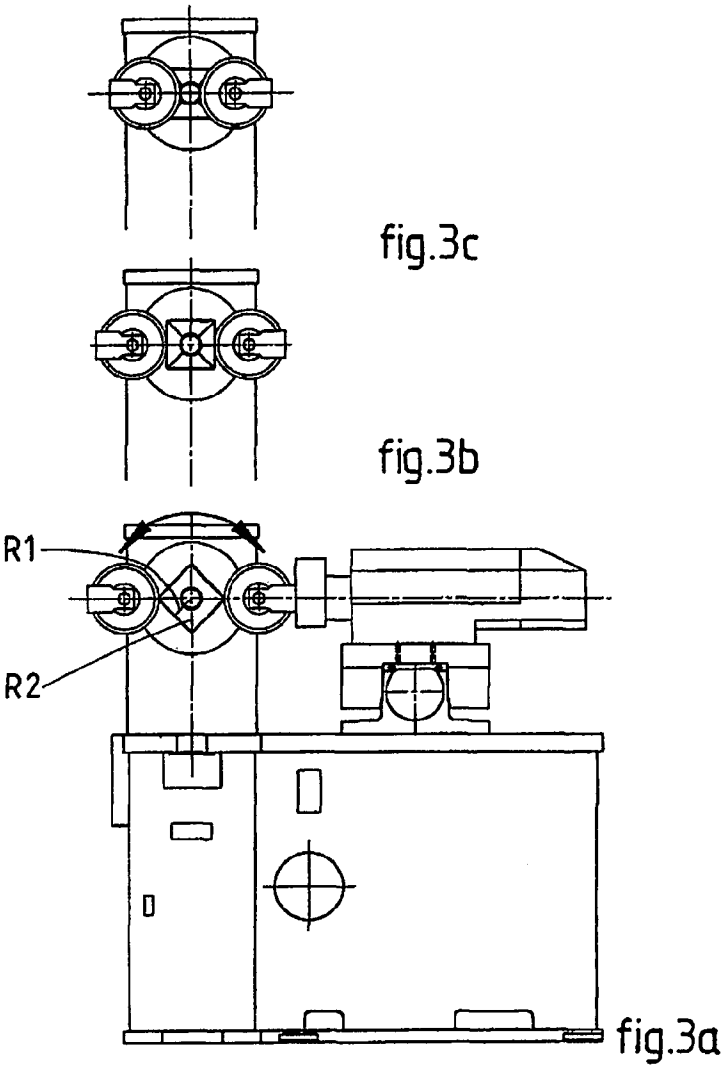
fig.3c
fig.3b
fig.3a
R1
R2
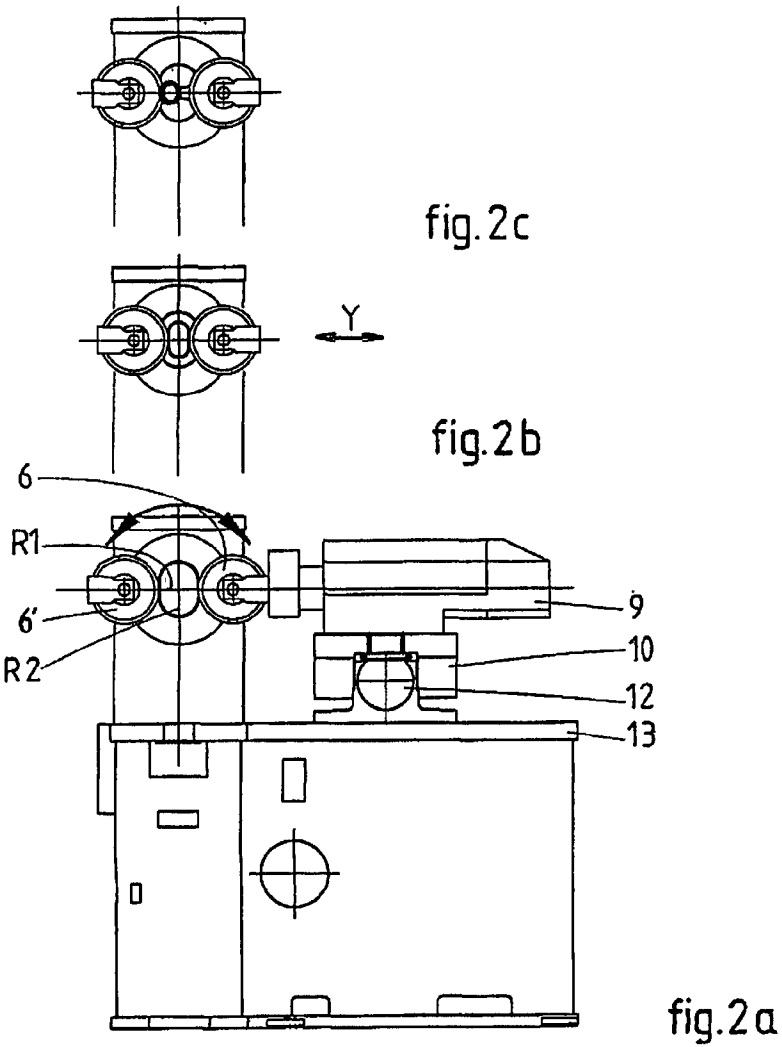
fig.2c
fig.2b
fig.2a
Y
9
10
12
13
6
R1
6'
R2

METHOD AND FORMING MACHINE FOR DEFORMING A HOLLOW WORKPIECE

CROSS-REFERENCE TO RELATED APPLICATION

This Application is a Section 371 National Stage Application of International Application No. PCT/NL01/00939, filed 21 Dec. 2001 and published as WO 02/062500 on Aug. 15, 2002 in English.

BACKGROUND OF THE INVENTION

The invention relates to a method for deforming a hollow workpiece having at least one open end, wherein the workpiece is clamped down in a clamping device, at least one forming tool is placed into contact with a wall of the workpiece, the workpiece and said forming tool are rotated about an axis relative to each other and the workpiece is deformed by means of the forming tool. The invention furthermore relates to a forming machine in accordance with the preamble of claim 9, by means of which a hollow workpiece having at least one open end can be deformed, and to a catalytic converter unit for a vehicle.

Such a method and forming machine are known, e.g. from European patent application EP 0 916 428. Said patent application discloses a forming machine comprising a forming head including a number of rollers, by means of which the diameter of one end of a circular cylindrical metal element is reduced, and in addition said end is bent through an angle.

To this end, the metal cylinder is clamped down and the forming head is rotated about an axis of rotation, after which said end is deformed by pressing the rollers in radial direction (relative to said axis of rotation) against the outer of the metal cylinder and moving them along said outer side in a number of cycles whilst decreasing the radial distance between the rollers and the axis of rotation with each cycle, as a result of which a reduction of the diameter is obtained. Since the axis of rotation extends at an angle to the central axis of the metal cylinder, the end of the cylinder is not only reduced as a result of the movement in radial direction of the rollers, but in addition said end will moreover be positioned at an angle. Due to the use of the aforesaid cycles, the workpiece assumes the shape of the final product in steps.

EP 0 916 426 discloses a comparable method and forming machine, in which the axis of rotation is eccentrically offset from the central axis of the metal cylinder. In this way a product is obtained wherein the central axis of the deformed part is likewise offset from the central axis of the non-deformed part of the metal cylinder.

The present method and apparatus can e.g. be used in the production of the housings of catalytic converters that form part of the exhaust system of vehicles, such as cars. The diameter of such catalytic converters is larger than the diameter of the pipes of the exhaust system of which they form part, and they are preferably positioned close to the engine block in order to reach their operating temperature as quickly as possible after the engine has been started, and in order to maintain that temperature as well as possible. A first consequence of this is that the diameter of the connections on either side of the catalytic converter housing must be reduced, in order to achieve a proper connection with the rest of the exhaust system, whilst furthermore said connections often need to have a complicated shape in order to be able to position them optimally with respect to the engine block.

The aforesaid known methods and forming machines for manufacturing workpieces having at least one deformed end only allow circular operations, which is inadequate, considering the increasingly complex shapes that designers require.

SUMMARY OF THE INVENTION

It is an object of the present invention to at least improve the freedom of design as regards shape.

In order to accomplish that objective, the method as described in the first paragraph is characterized in that the tool can be moved back and forth with respect to the axis during at least part of the deforming operation, preferably in radial direction and substantially in a translating fashion, at a frequency which is substantially equal to or a multiple of the frequency of the rotation of the deformed part, or the part to be deformed, of the workpiece about the aforesaid axis. The control of the forming machine according to the invention is arranged accordingly.

As will be explained in more detail in the examples below, it is possible in this way to realise much more complex shapes, such as oval, triangular or polygonal shapes or shapes derived therefrom. In addition, it is possible to deform the workpiece in such a manner that the central axis of the deformed part of the workpiece will be positioned at an angle or eccentrically with respect to the undeformed part, whilst it is also possible to position an insert in the open end of the workpiece before or during the operation. Such an insert may function to facilitate or enable a particular operation and/or may form a part of the final product.

Preferably, the workpiece is rotated whilst the tool is translated, during which translating movement the tool remains stationary in the direction of rotation. This makes it possible to carry out the deforming operation in a relatively simple manner, possibly entirely or partially by means of existing equipment and tools.

The invention furthermore relates to a catalytic converter unit for a vehicle, such as a car, comprising a workpiece obtained by using a method according to the invention as described above.

BRIEF DESCRIPTION OF THE DRAWINGS

The invention will now be explained in more detail with reference to the appended figures, which show a number of embodiments of the method and the forming machine according to the present invention.

FIGS. 2*a*–3*c* show in side elevation several processing steps of the method according to the invention being carried out with the forming machine according to FIG. 1.

Insofar as parts are identical in the various embodiments or perform the same function, these parts will consistently be indicated by the same numeral.

DETAILED DESCRIPTION OF THE ILLUSTRATIVE EMBODIMENTS

Figure 1:
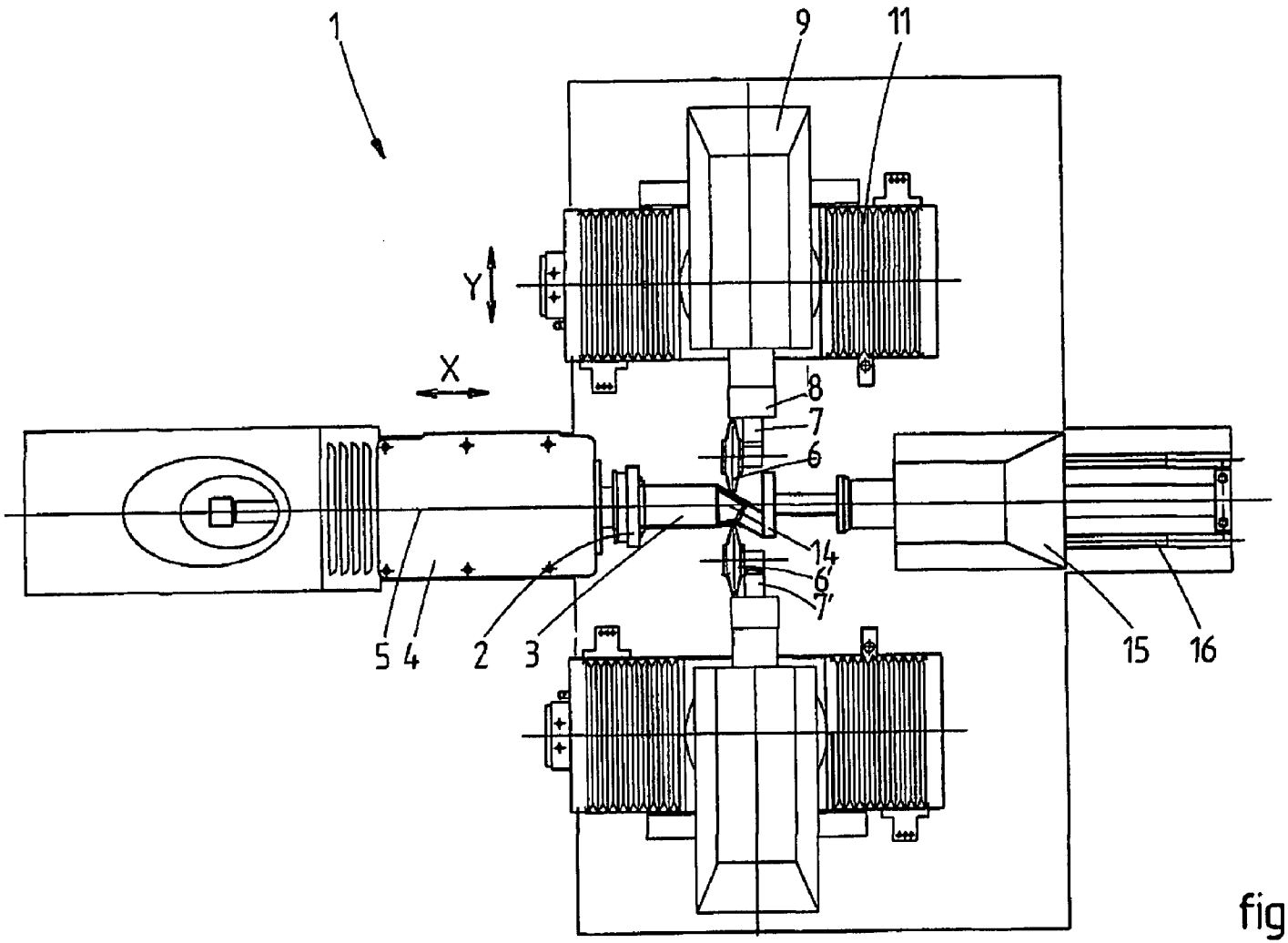
FIG. 1 is a schematic top plan view of a first forming machine according to the present invention, comprising two tools and a rotatable chuck.

FIGS. 1 and 2 show a forming machine 1 comprising a chuck 2 for clamping down a workpiece, such as the illustrated, already deformed metal cylinder 3. The chuck 2 can be rotated about an imaginary axis 5, for example by means of an electric motor present within the housing 4. Disposed on either side of the workpiece 3 is a forming tool, such as a forming roller 6, 6', which is rotatably mounted on a respective holder 7, 7', which is fitted in an upper slide 8 in a housing 9. The upper slide 8, and thus the forming roller 6, can be moved back and forth over a guide, for example by means of a hydraulic servo motor, in a direction which extends at angle of e.g. 45–90° to the axis 5, which direction will be called the Y-direction hereinafter. The housing 9 is mounted on a lower slide 10 (see FIG. 2), which comprises bellows 11 and which is mounted on a guide 12, which in turn forms part of a machine bed 13. The lower slide 10 can be moved back and forth over said guide 12, again by means of an hydraulic servo motor, for example, in a direction which extends perpendicularly to the direction of movement of the upper slide 8, which direction will be called the X-direction hereinafter.

Instead of using the illustrated arrangement, it is also possible to position the housing so that it is capable of translating movement in the X-direction. In that case, the forming tools can remain stationary in this direction. For more details about a suitable assembly of a forming roller and the associated slide and driving means, reference is made to European patent application EP 0 125 720.

With the operation that is shown in FIGS. 2*a*–2*c*, a hollow metal cylinder 3 having an oval sectional shape is set up. This oval cylinder 3 is rotated at a suitable speed with the forming rollers 6, 6' being pressed against the outer wall thereof. The forming rollers 6, 6' are controlled in such a manner that they translate back and forth in the Y-direction at a frequency which is twice as high as the frequency of the rotation of the oval cylinder 3. The extreme positions of this movement are determined by the shortest and the longest radius R1 and R2, respectively, of the outer circumference of the oval cylinder 3. The acceleration of the forming rollers 6, 6' is set such that initially the forming rollers 6, 6' merely follow the outer wall of the workpiece. Following that, the forming rollers 6, 6' and the oval cylinder 3 can be moved in the X-direction relative to each other, for example in such a manner that the forming rollers 6, 6' are initially spaced from the end of the workpiece 3 by some distance and then move towards this end. During this movement, the part in question of the workpiece can be deformed by adjusting the reciprocating translating movement of the forming rollers 6, 6'.

With regard to the shape that is shown in FIG. 2*b*, this means that the two extreme positions of the movement of each of the forming rollers 6, 6' move further and further towards the axis 5. If the oval cylinder 3 is to be given a circular end, the amplitude of the reciprocating translating movement will slowly be decreased and eventually end at a constant distance from the aforesaid axis 5. By additionally moving both of the extreme positions of the right-hand (in the drawing) forming roller 6 towards the axis 5, as shown in FIG. 2*c*, whilst on the other hand moving the extreme positions of the left-hand forming roller 6' away from this axis, the deformed part of the cylinder 3 will be positioned at an angle with respect to the undeformed part. Depending on, amongst other things, the properties of the material, the wall thickness, the magnitude of the deformation and the diameter reduction, the operation will have to be carried out in more or in fewer passes or steps.

FIG. 3 shows the deformation of the end of a hollow metal cylinder of square section, in such a manner that said sectional shape gradually blends into a circular section having a (considerably) smaller diameter. Also in this case the forming rollers 6, 6' move between two extreme positions corresponding to, respectively, one half of a rib of said square and one half of a diagonal of said square, which are indicated at R1 and R2, respectively. During a first pass of the forming rollers 6, 6' along the workpiece 3, said values are reduced by a number of percent and, in addition, a sectional shape is imposed in which the corners are slightly rounded already. Eventually, the shape as shown in FIGS. 3*a*–3*c* is obtained by repeating this movement and imposing a diameter decreasing towards the end and an increasingly round sectional shape.

Figure 4:
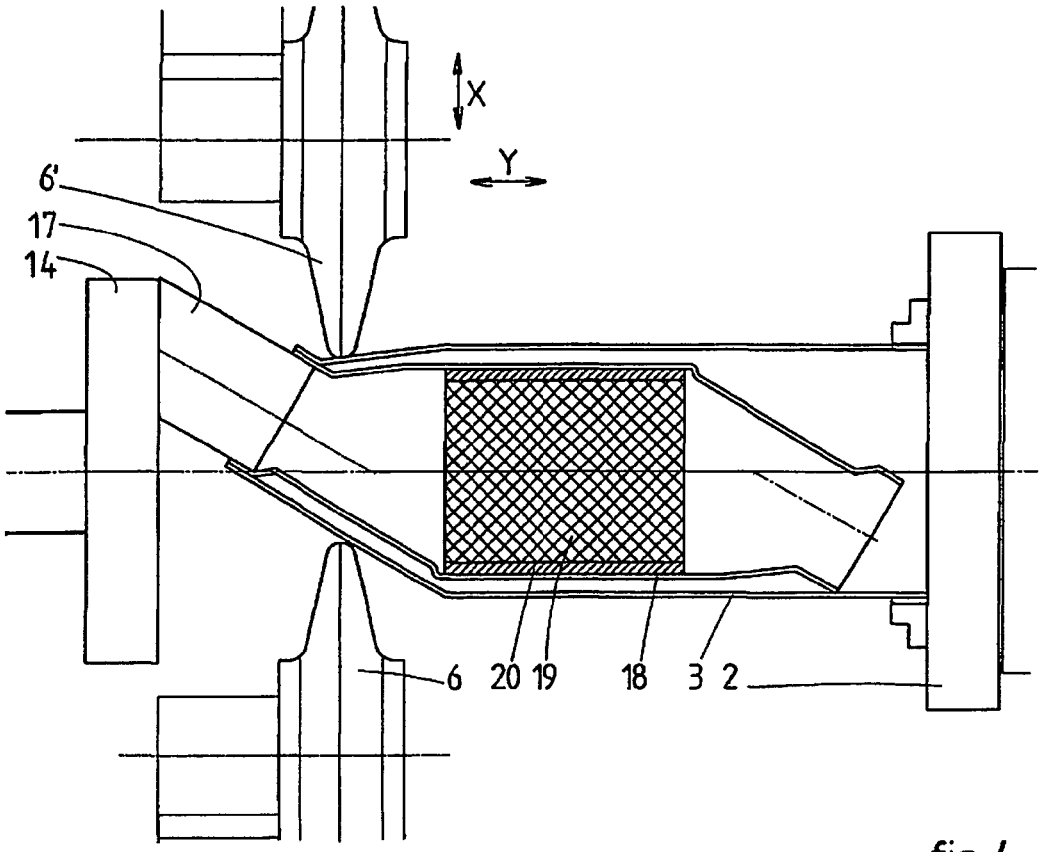
FIG. 4 is a partially sectional top plan view of a processing step of a catalytic converter.

In contrast to the prior art methods and forming machines, it is possible with the method and the forming machine according to the present invention to place an insert into the hollow workpiece, in this case a metal circular cylinder 3, as is shown in FIG. 4, and keep it in a desired position with respect to this circular cylinder 3. To this end, the forming machine 1 is provided with a chuck 14, which is rotatably mounted about the axis 5 in a housing 15 that can be moved forwards and backwards by means of a slide (not shown) over two guide rails 16 which are in line with the axis 5. The chuck 14 can be rotated about the imaginary axis 5, for example by means of an electric motor (not shown) or by coupling the chuck 14 mechanically with the chuck 2 or the driving mechanism thereof. The chuck 14 is provided with an eccentric clamping piece 17, on which the insert can be clamped down. To this end, the clamping piece may for example be provided, in a manner which is known per se, with an expandable annular element.

In the illustrated example, the insert consists of an inner housing 18 for a catalytic converter unit 21, which inner housing has already been deformed by using a method according to the present invention and which includes a so-called catalytic brick or substrate and an associated, insulating shell 20. The ends of the inner housing 18 are conical in shape, which cone extends at an angle to the central axis of the inner housing 18, which coincides with the axis 5. The inner housing 18 and the circular cylinder 3 may also have a sectional shape as shown in FIGS. 2*a*–2*c* rather than a circular cylindrical sectional shape.

Figure 5:
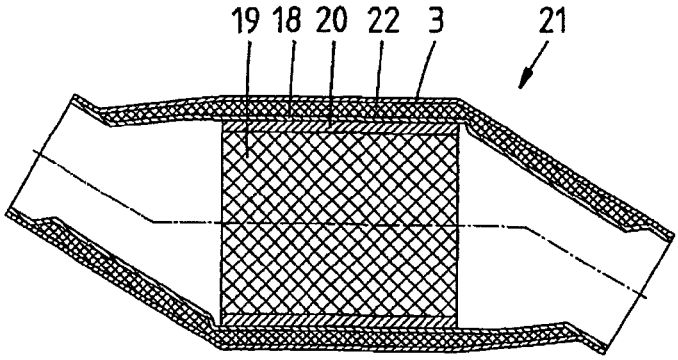
FIG. 5 is a cross-sectional view of a finished catalytic converter unit.
Figures 7A, 7B, 7C:
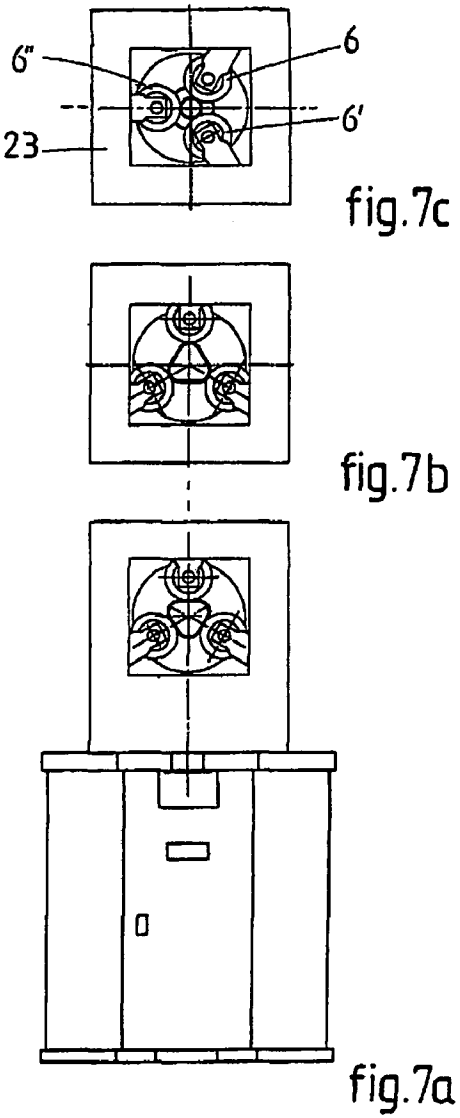
FIGS. 7*a*–7*c* show in side elevation several processing steps of the method according to the invention being carried out with the forming machine according to FIG. 6.

During the forming operation, the forming rollers 6, 6' follow five paths, for example, in a manner which is comparable to that which is shown in FIGS. 2*a*–2*c*, thus deforming the end of the cylinder 3 into a cone which extends largely parallel to the left-hand end of the inner housing 18. The outermost parts of said ends abut each other so closely that the inner housing 18 is clamped down in the cylinder 3. Following that, the cylinder 3 and the inner housing 18 that is clamped down therein can be turned over and be fixed in the chuck 2 again, so that the other end can be worked. Thus, the catalytic converter 21 that is shown in FIG. 5 is obtained, which enables a good insulation of the catalytic brick or substrate 19. Other parts, such as an insulating filler 22, may be introduced between the outer wall of the inner housing 18 and the inner wall of the cylinder 3. It is also possible to use an insert which does not remain behind in the workpiece, but which is only present in the workpiece during the forming operation for support or for working the inner wall of the workpiece.

From the foregoing it will be understood that this method and forming machine according to the present invention creates new possibilities and allows the manufacture of composite products having complex shapes. In principle it is possible to use existing equipment for this purpose.

Figure 6:
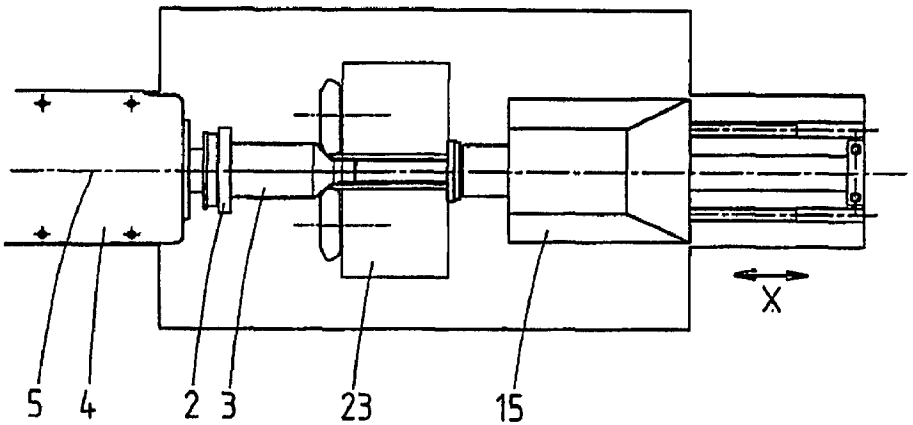
FIG. 6 is a schematic top plan view of a second forming machine according to the present invention, comprising three tools and a rotatable chuck.

FIG. 6 shows a second forming machine according to the present invention, in which three forming rollers 6, 6', 6" are disposed in a frame 23 in such a manner that the contact points of said forming rollers 6, 6', 6" are equidistantly distributed over the circumference of the workpiece 3, which in this case consists of a metal cylinder of triangular section with rounded corners. By translating the forming rollers 6, 6', 6" reciprocatingly at a frequency that corresponds to three times the frequency of the rotation of the workpiece 3, in combination with reciprocating movement in radial direction between extreme positions that correspond to half the largest diameter and half the smallest diameter of the workpiece, it is possible to follow and deform the outer surface of the cylinder 3. Moving the frame 23 and the workpiece 3 in the X-direction parallel to the axis 5 with respect to each other makes it possible to follow a number of paths, thus creating the final narrowed and circular sectional shape at the end of the workpiece 3.

The above-described forming machines all comprise a control unit. Such a control unit is e.g. arranged for controlling the means for movement in the X and Y-directions and in the radial direction of the rollers in accordance with a control programme that is stored in a memory, in such a manner that the forming rollers follow one or more desired paths with respect to the workpiece so as to deform the workpiece into the desired product or intermediate product.

The invention is not restricted to the embodiments as described above, which can be varied in several ways without departing from the scope of the invention as defined in the claims.

The invention claimed is:

1. A method for deforming a hollow workpiece having at least one open end, wherein the workpiece is clamped down in a clamping device and at least one forming tool is placed into contact with a wall of the workpiece, the method comprising:

rotating the workpiece and said forming tool about an axis relative to each other; and engaging the forming tool against the workpiece to deform the workpiece during a deforming operation wherein, the tool is moved back and forth with respect to the axis during at least part of the deforming operation, at a frequency which is substantially equal to or a multiple of the frequency of the rotation of a deformed part, or a part to be deformed, of the workpiece about the aforesaid axis.

2. The method according to claim 1, wherein the workpiece is rotated whilst the tool is driven substantially in a translating fashion, during which the tool remains substantially stationary in the direction of rotation.

3. The method according to claim 1, wherein the step of engaging includes moving the tool back and forth in a direction which intersects the axis at least substantially.

4. The method according to claim 1, wherein the step of engaging includes deforming the workpiece in such a manner that the central axis of the deformed part of the workpiece extends at an angle or is positioned eccentrically with respect to an undeformed part.

5. The method according to claim 1, wherein a number of tools corresponds to said multiple and wherein the step of engaging includes engaging the tools at contact points equidistantly distributed over the circumference of the workpiece.

6. The method according to claim 1 and further comprising providing an insert in the open end of the workpiece before or during the step of engaging.

7. The method according to claim 6, wherein the step of engaging includes deforming the workpiece in such a manner that the insert is disposed therein.

8. The method according to claim 1, wherein the step of rotating includes rotating the workpiece such that the axis about which the workpiece and the tools are rotated with respect to each other coincides with the central axis of an undeformed part of the workpiece.

9. A forming machine comprising:

a rotatable clamping device for clamping down a hollow workpiece having at least one open end that is to be deformed;

a forming tool which during working the workpiece can be placed into contact with an outside surface of the workpiece to deform the workpiece;

means for moving the workpiece and said forming tool relative to each other about an axis;

means for moving the workpiece and the forming tool relative to each other in such a manner that the forming tool can follow one or more desired paths for working the workpiece; and a control unit for said means, wherein, the control unit is configured for causing relative movement of the forming tool back and forth with respect to the axis during at least part of the deforming operation, at a frequency which is substantially equal to or a multiple of the frequency of the rotation of a deformed part, or a part to be deformed, of the workpiece about the aforesaid axis.

10. The forming machine according to claim 9, wherein a number of forming tools corresponds to said multiple.

11. The forming machine according to claim 9 and further comprising a rotatable support for an insert to be placed in the open end of the workpiece that is disposed opposite the clamping device.

* * * * *